US005078398A

United States Patent [19]

Reed et al.

[11] Patent Number: 5,078,398

[45] Date of Patent: Jan. 7, 1992

[54] INFINITELY BALANCED, HIGH MOMENT OF INERTIA GOLF PUTTER

[75] Inventors: Timothy R. Reed, Buffalo Grove; James E. Karner, Grayslake, both of Ill.

[73] Assignee: Tommy Armour Golf Company, Morton Grove, Ill.

[21] Appl. No.: 468,748

[22] Filed: Jan. 24, 1990

[51] Int. Cl.[5] ..... A63B 53/02; A63B 53/04

[52] U.S. Cl. ..... 273/80 A; 273/167 G; 273/173; 273/DIG. 8; 273/DIG. 14; 273/80 C; 273/169

[58] Field of Search ..... 273/167-175, 273/164, 80 A, 80 C, DIG. 8, DIG. 14; D21/217-219

[56] References Cited

U.S. PATENT DOCUMENTS

| | | | |
|---|---|---|---|
| D. 252,649 | 8/1979 | Bernhardt | D21/217 |
| D. 257,782 | 1/1981 | Bernhardt | D21/217 |
| D. 257,783 | 1/1981 | Bernhardt | D21/217 |
| D. 259,134 | 5/1981 | Bernhardt | D21/217 |
| D. 269,029 | 5/1983 | Lowry | D21/219 |
| D. 275,214 | 8/1984 | Bernhardt | D21/219 |
| D. 275,215 | 8/1984 | Bernhardt | D21/219 |
| D. 275,216 | 8/1984 | Bernhardt | D21/219 |
| D. 275,217 | 8/1984 | Bernhardt | D21/219 |
| D. 275,591 | 9/1984 | Bernhardt | D21/219 |
| D. 275,592 | 9/1984 | Bernhardt | D21/219 |
| D. 275,981 | 10/1984 | Duclos | D21/219 |
| D. 306,334 | 2/1990 | Alcala | D21/219 |
| D. 307,043 | 4/1990 | Werner | D21/219 |
| 2,820,638 | 1/1958 | Morrison | 273/164 |
| 2,926,913 | 3/1960 | Stecher | 273/167 J X |
| 3,194,564 | 7/1965 | Swan | 273/168 X |
| 3,966,210 | 6/1976 | Rozmus | 273/169 |
| 4,163,554 | 8/1979 | Bernhardt | 273/80 |
| 4,265,451 | 5/1981 | Bernhardt | 273/167 |
| 4,325,553 | 4/1982 | Taylor | 273/167 |
| 4,390,184 | 6/1983 | Rudell | 273/183 |
| 4,426,083 | 1/1984 | Dishner, Jr. | 273/164 |
| 4,432,549 | 2/1984 | Zebelean | 273/167 H |
| 4,438,931 | 3/1984 | Motomiya | 273/167 H |
| 4,508,350 | 4/1985 | Duclos | 273/183 |
| 4,511,145 | 4/1985 | Schmidt | 273/167 H |
| 4,679,792 | 7/1987 | Straza et al. | 273/78 |
| 4,693,478 | 9/1987 | Long | 273/164 |
| 4,722,528 | 2/1988 | Tsao | 273/164 |
| 4,795,158 | 1/1989 | Kuykendall | 273/164 |
| 4,824,110 | 4/1989 | Kobayashi | 273/78 |
| 4,824,115 | 4/1989 | Walther | 273/169 |
| 4,828,266 | 5/1989 | Tunstall | 273/171 |
| 4,832,344 | 5/1989 | Werner | 273/163 |
| 4,834,387 | 5/1989 | Waites et al. | 273/164 |
| 4,848,747 | 7/1989 | Fujimura et al. | 273/167 H X |
| 4,852,879 | 8/1989 | Collins | 273/164 |
| 4,852,880 | 8/1989 | Kobayashi | 273/169 |
| 4,866,979 | 9/1989 | Bernhardt | 73/65 |
| 4,890,840 | 1/1990 | Kobayashi | 273/167 H |
| 4,898,387 | 2/1990 | Finney | 273/167 |
| 4,913,438 | 4/1990 | Anderson | 273/164 |

FOREIGN PATENT DOCUMENTS

| | | | |
|---|---|---|---|
| 3806 | of 1927 | Australia | 273/80 C |
| 14608 | of 1905 | United Kingdom | 273/80 C |

*Primary Examiner*—Edward M. Coven
*Assistant Examiner*—Sebastiano Passaniti

[57] ABSTRACT

An improved golf putter club is disclosed in which the club head, hosel, shaft and grip are so configured that the club's total weight is perfectly centered and balanced about the club's shaft axis, resulting in multi-directional stability, i.e., infinite balancing, against any static forces causing the putter club head to rotate off line about the shaft, grip, and hosel axis. Such rotational stability eliminates any inherent twisting forces of the putter head during use. An extremely high moment of inertia about the club head's center of gravity results from use of a relatively heavyweight material for the ball striking face, the club heel and toe ends, and the adjacent sole portions, while an insert formed of a relatively lightweight material is used to fill in the club head's central area where heavyweight material is absent. This high rotational moment of inertia assures that when a golf ball is hit off-center (i.e., struck on the face at a distance from the club head's center of gravity) only a minimal angular acceleration is produced by the club head on the golf ball being struck. The above advantages are provided in a putter having a slight onset design.

24 Claims, 5 Drawing Sheets

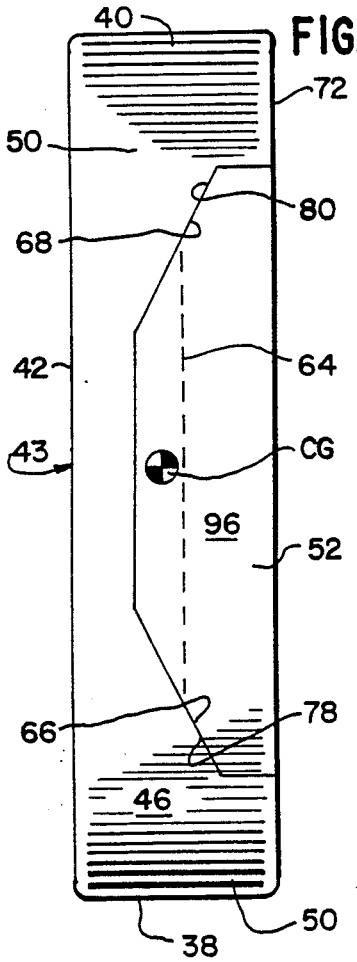
FIG. 8
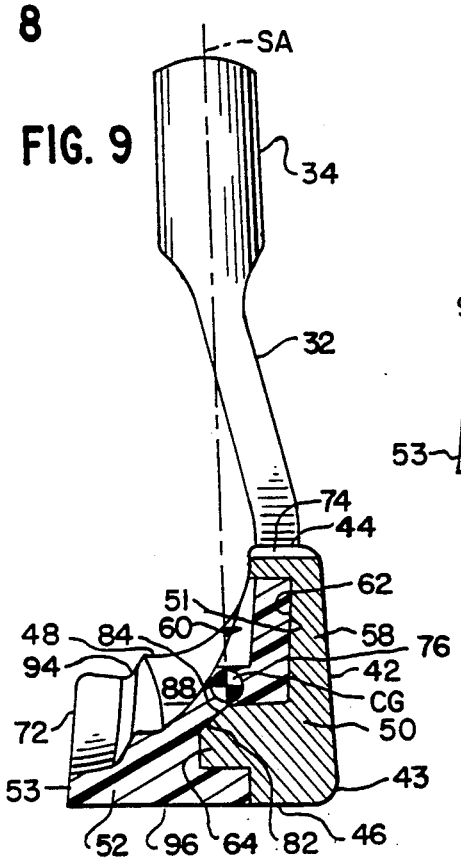
FIG. 9
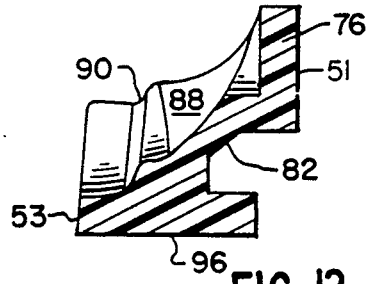
FIG. 12
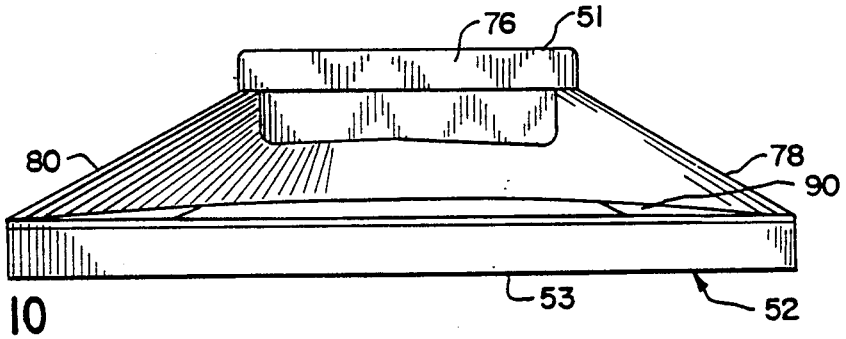
FIG. 10
FIG. 11
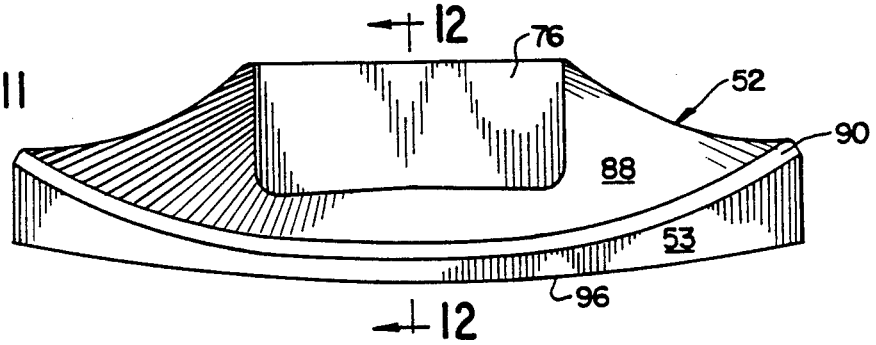

FIG. 13a
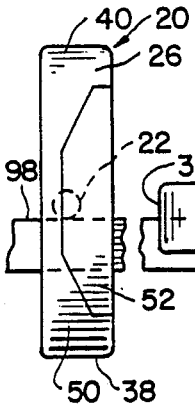
FIG. 13b
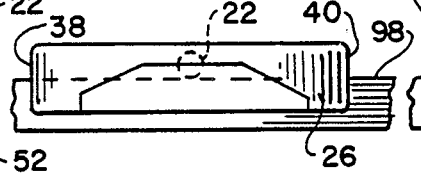
FIG. 13c
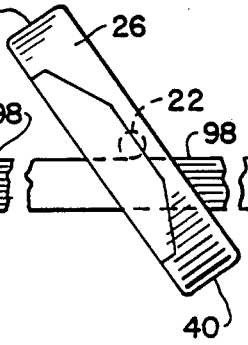
FIG. 13d
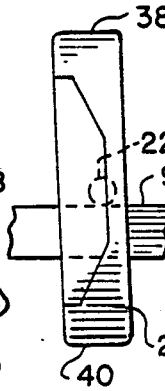
FIG. 13e
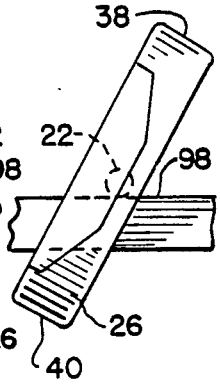
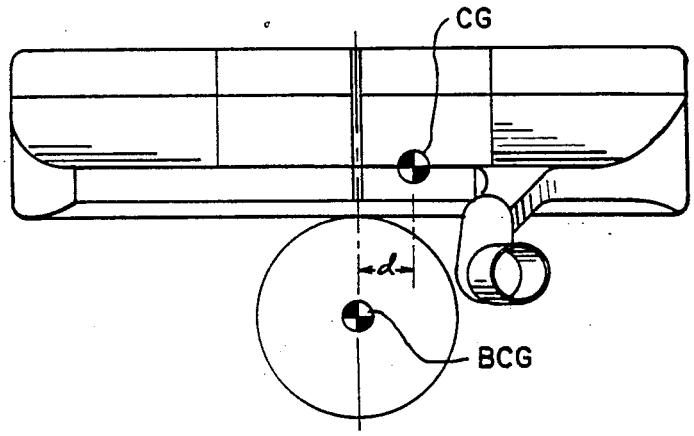
FIG. 14
PRIOR ART
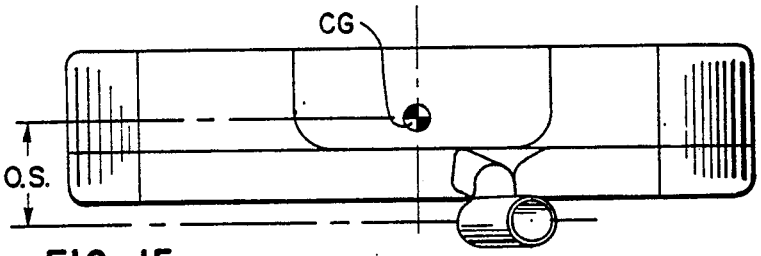
FIG. 15
PRIOR ART
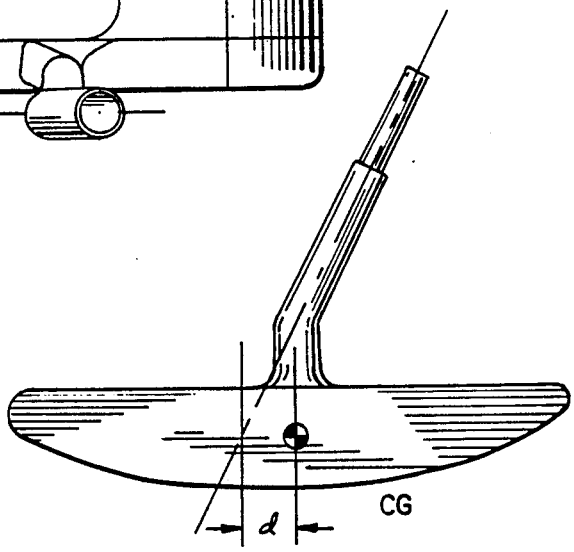
FIG. 16
PRIOR ART

INFINITELY BALANCED, HIGH MOMENT OF INERTIA GOLF PUTTER

FIELD OF THE INVENTION

This invention relates to golf clubs, and more specifically to a golf putter that is infinitely balanced for stability against unwanted rotation coupled with a high moment of inertia.

BACKGROUND OF THE INVENTION

There have been numerous attempts to create a golf club putter which provides a high accuracy with each putting stroke. Generally, a golf putter club has a centrally-located point of desired contact on the club head (sometimes called the strike point, sweet spot or impact spot), a specific location for the club head's center of gravity, which club head center of gravity often has no relation whatsoever to the impact spot, as well as a specific location for the entire club's center of gravity (occurring after the shaft and grip have been affixed to the club head).

In many prior putters, the club's axis of rotation, i.e., the club's Z axis, is not coaxially aligned with the club face's strike point in the direction of putter stroke movement. Therefore, even if a golfer hits what appears to be a "center hit" ball, because the axis of rotation, i.e., plane containing the entire golf putter's center of gravity, is offset from the club face's strike point, some amount of angular acceleration is undesirably imparted to the ball. This affects the ball's accuracy in terms of direction and speed.

One known putter is of the so-called face-balanced design where the putter head's strike point is aligned offset of the club head's axis of rotation in a plane forward of the face. The name "face balanced" derives from when such a club is laid horizontal on a table surface, with the club head hanging over the edge of the table and allowed to freely rotate about the shaft, the club head face will come to rest aligned horizontally with the table surface and facing up. However, the disadvantage with such putters is that there are inherent forces tending to twist the face open before impact. This is due to the fact that the entire club's axis of rotation is offset forward of the club head's strike point. As a result, the golfer is not assured that the putter head will be perpendicular, i.e., square, to the intended line of club head travel at impact causing misdirection in putting, so a golfer must necessarily use his skill and abilities to overcome such inherent twisting forces. Examples of such face-balanced putters are typified by U.S. Pat. Nos. 4,325,553 and 4,722,528. (The present FIG. 15 depicts the typical offset—labelled "O.S."—of a prior art face-balanced putter's club head's center of gravity relative to the shaft axis.)

Yet another known putter is of the so-called table-balanced design, the head of which, when the putter is laid upon a horizontal table surface with the club head hanging freely beyond the edge, will come to rest with the putter's striking face aligned vertically, rather than horizontally as with the face-balanced design. However, the disadvantage with such a putter design is that there are inherent forces tending to twist the face open at impact, i.e., angular acceleration. This is due to the fact that the entire club's axis of rotation bisects the club head at a point different from the club head's strike point. That is, the plane containing the entire club's center of gravity, i.e., club's axis of rotation, is not aligned with the same vertical plane as the putter's strike point, but instead will be located towards the club head's toe or heel. As a result of this, the golfer is assured that the putter face will return back to square, i.e., perpendicular to the intended line of club head travel. However, because of that misalignment of the entire club's axis of rotation relative to strike point, dynamic forces at impact cause the putter head to rotate closed, i.e., angular acceleration is present. The net result of such twisting is that the golf ball will be caused to travel to the left for a right-handed golfer. Examples of such table-balanced putters are typified by U.S. Pat. Nos. 4,165,554 and 4,852,879. (The present FIG. 16 depicts the typical offset distance—labelled "d"—of a prior art table-balanced putter's club head's center of gravity relative to the shaft axis.)

Many prior putters used a lightweight material (such as aluminum, for example) for the main putter body, and then tried to create a higher moment of inertia by adding a heavyweight material (such as lead or brass, for example) to the toe and heel areas.

No one prior putter simultaneously provides the desired goals of eliminating the known putters' tendency to twist during pendulum-swinging and at impact (due to static and dynamic forces), and achieving a high moment of inertia such that if a golf ball is hit off-center, the club head will nevertheless tend to resist undue twisting thereby minimizing any unwanted angular acceleration imparted to the golf ball.

SUMMARY OF THE INVENTION

The present invention assures that no unwanted rotational or other twisting forces are inherently imparted by the putter to the ball by coaxially aligning the club's shaft axis with the mass center of the club head, i.e., with the club head's center of gravity. There results a perfectly, i.e., infinitely, balanced putter which, regardless of how the putter head is aligned when the club is laid on a horizontal surface (with the club head hanging freely over the edge), the club head will always stay as originally aligned. Accordingly, there are no unwanted inherent forces in the club head due to improper weight distribution and/or shaft-misalignment which might tend to cause the club head to rotate to some other position. Thus, regardless if shots are hit on or off-center, i.e., on or away from the desired striking point, there are no unwanted forces inherently created within the club head which the golfer must try to overcome to assure that the putter head remains properly aligned in a plane perpendicular to the direction of club stroke towards the target at the moment of impact with the ball. This promotes accuracy in putting.

Simultaneously, through their respective placement and the selection of specific weight materials for the putter head's two component parts, the club achieves an extremely high moment of inertia. This is also a feature important in assuring putting accuracy. That is, the present invention includes a club head made primarily of a heavyweight metallic material which has a substantial portion of its weight, i.e., 75% or more, and preferably 95%, equally located at its striking face, weighted heel and toe, and adjacent sole areas. This is achieved through use of a lightweight material for the club head's central area, where no heavyweight material is present.

Further, the foregoing advantages are achieved in a putter design which has a slight onset, i.e., a putter where the shaft and hosel are located somewhat behind, instead of in front of and thus visually in the way of, the golf ball at the address and impact positions.

Accordingly, it is an object of the present invention to provide a golf putter which is perfectly balanced about its shaft axis so that no unwanted forces are inherently created either statically or dynamically.

It is a further object of the present invention to provide a golf putter of the desirable onset style in which the shaft axis is coaxially aligned with the center of gravity of both the club head and of the entire club.

It is yet a further object of the present invention to provide a golf putter the head of which has the striking face and substantially all of the toe and heel portions formed from a relatively hard, heavy metallic material while the central area of the club, including a portion of the sole thereof, is formed from a relatively lightweight material, whereby an extremely high moment of inertia is provided by the club head.

It is a still further object of the present invention to provide a golf club putter in which the desired striking point is centered at the club face's true geometric center and is also aligned (in a plane perpendicular to the club's striking face) with the club head's center of gravity.

It is yet another object of the present invention to provide a golf putter head having infinite stability against rotation, both statically and dynamically due to coaxial alignment of the shaft axis with the club head's center of gravity, in combination with having a high moment of inertia so as to minimize twisting and imparting unwanted angular acceleration to golf balls hit off-center.

It is yet an additional object of the present invention to provide a putter club which transfers maximum energy to the ball being struck since no unwanted angular acceleration is created (for center hit balls) because the club head's striking point is aligned centrally of the club head and in alignment with the club head's center of gravity.

The means by which the foregoing and other objects of the present invention are accomplished and the manner of their accomplishment will be readily understood from the following specification upon reference to the accompanying drawings, in which:

FIG. 8 is a bottom plan view of the putter head of FIG. 1;

FIG. 9 is a cross-sectional view taken through the center of the putter head of FIG. 2 along lines 9—9 thereof;

FIGS. 10 & 11 are a top plan view and a rear elevation view, respectively, of the insert portion of the putter head of FIG. 1;

FIG. 12 is a vertical section view of the insert portion depicted in FIG. 11, as taken along lines 12—12 thereof;

Figure 1:
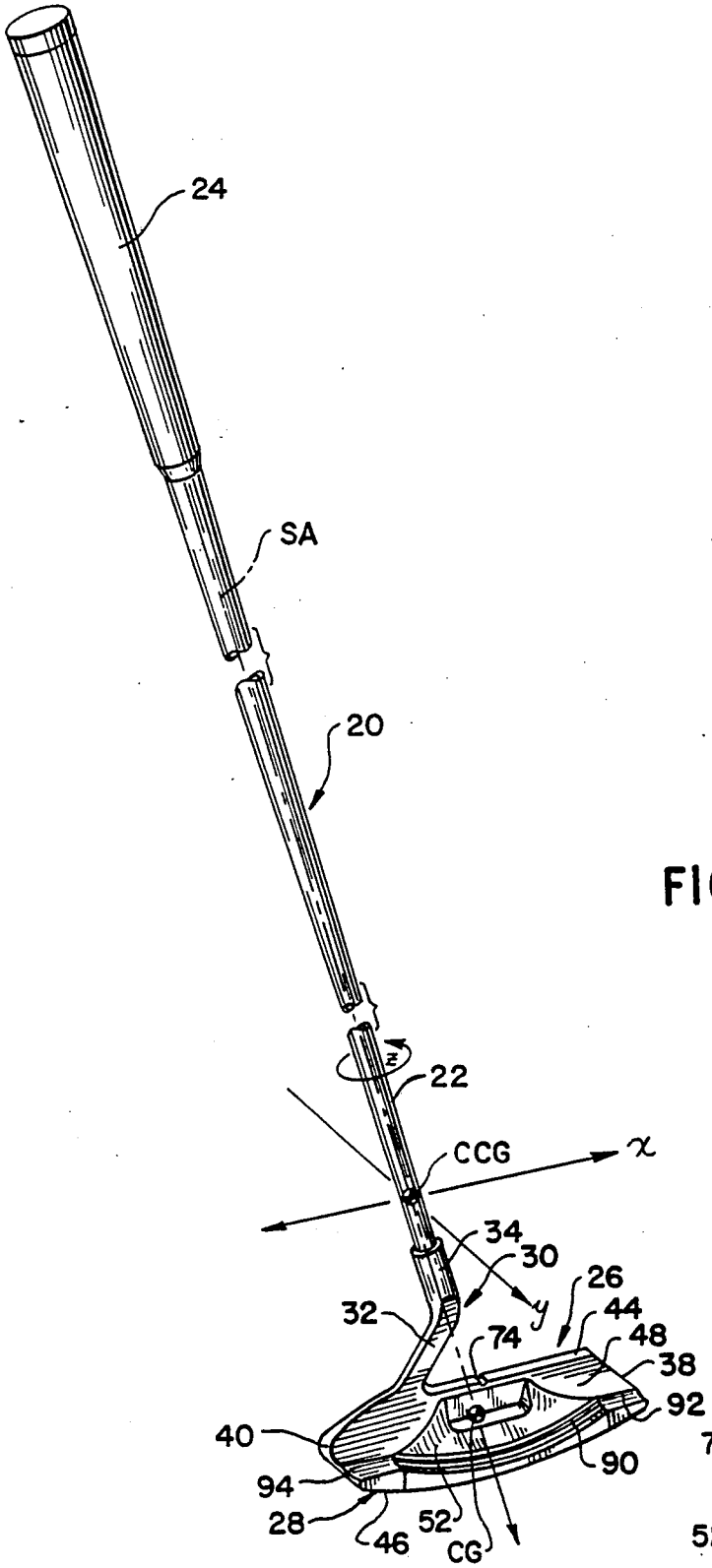
FIG. 1 is a reduced size rear perspective view of the entire club of the present invention.
Figure 4:
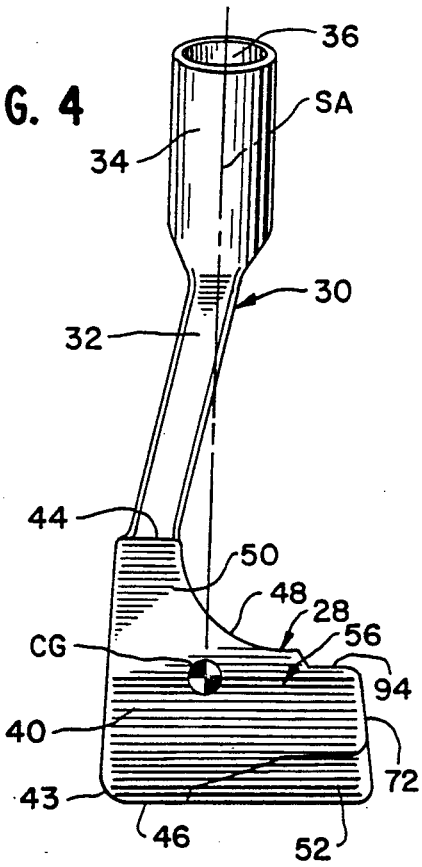
FIG. 4 is a heel-end elevation view of the putter head of FIG. 1.
Figure 5:
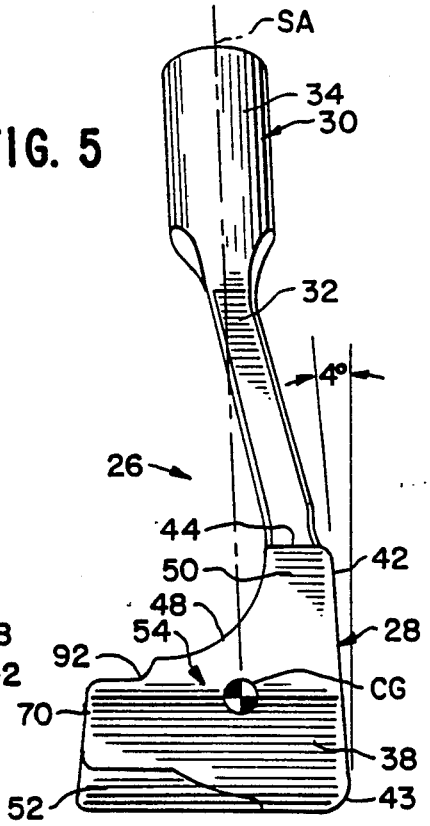
FIG. 5 is a toe end elevation view of the putter head of FIG. 1.

FIGS. 13*a*–13*e* are a series of figures depicting in schematic format the balanced location of the putter head of FIG. 1 when the club is laid on a horizontal table surface with the club head depicted as placed at several different positions;

FIG. 14 is a top plan view of a prior art putter head;

FIG. 15 is a top plan view of another prior art putter head; and

FIG. 16 is a front elevation view of yet another prior art putter head.

DESCRIPTION OF THE PREFERRED EMBODIMENT

Having reference to the drawings wherein like reference numerals indicate corresponding elements, there is shown in FIG. 1 an illustration of a putter golf club, generally depicted by reference numeral 20. The putter 20 comprises an elongated shaft 22 carrying at one end a grip 24 and at its other end a putter club head generally denoted by reference numeral 26.

As best seen in FIGS. 1–8, the head 26 comprises a body portion 28 and a hosel portion 30 integrally formed therewith. The hosel portion 30 comprises an upwardly and inwardly directed first or stem portion 32 (see FIGS. 2–5) terminating in a shaft socket or hosel barrel 34 having an opening 36 for tightly receiving the lower tip end of shaft 22 in a well known fashion.

The body portion 28 of putter head 26 (see FIGS. 2–9) generally comprises a toe end 38, a heel end 40, a front striking face 42, a generally planar top edge surface 44, a gradually radiused sole surface 46, and a generally curved, configured rear surface 48. As seen in FIGS. 4, 5, 8, and 9, the striking face 42 flows into the sole 46 through a radiused lower front edge 43. The striking face 42 preferably inclines from lower edge 43 at about 4° to the horizontal (see FIG. 5); this inclination assures that a properly hit ball will have a reduction in initial skidding on the putting surface, i.e., roll more accurately in the direction of putting stroke.

The putter head 26 includes two separate portions (see generally FIG. 8), each of which is formed of different weight materials. The two portions then are integrally joined by mechanical means, such as by adhesive bonding, for example. That is, putter head 26 includes a first major heavyweight component 50 (see FIG. 7) which is preferably formed of a hard, relatively heavy metallic material, such as cast stainless steel, for example. The body component 50 thus forms the major structural element of the putter head 26, except for a lightweight central insert component 52 (see FIGS. 10–12). More specifically (see FIGS. 2–9), the heavier component 50 comprises the hosel 30, toe 38, heel 40, front striking face 42, the curved, rearwardly extending wing portions 54, 56 (see FIGS. 4–7, which portions respectively form the massively weighted toe and heel sections), the relatively thin web portion 58 (see FIG. 9, which portion connects the toe and heel weighted wing portions 54, 56), and that much of the adjacent portion of the sole 46 as is shown in FIG. 8.

A heavyweight material is preferably used for the body component 50 as this is hard and that gives a better hitting surface as well as a better casting and machining surface for striking face 42. Additionally, it gives a much higher moment of inertia for club head 26 than if a lighter weight material was used, all as described more fully later herein.

Figure 6:
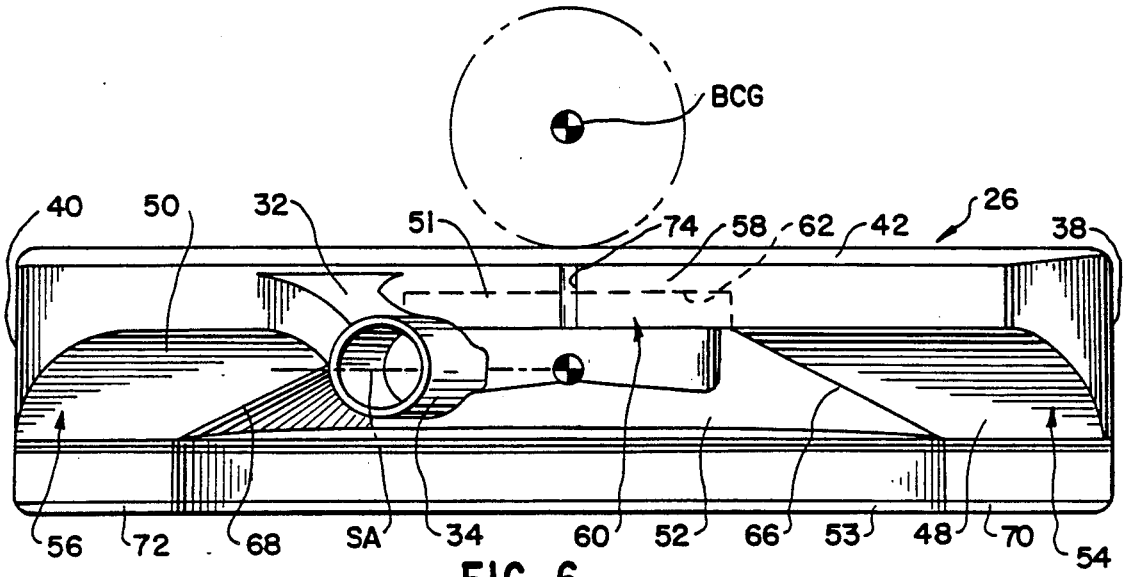
FIG. 6 is a top plan view of the putter head.
Figure 7:
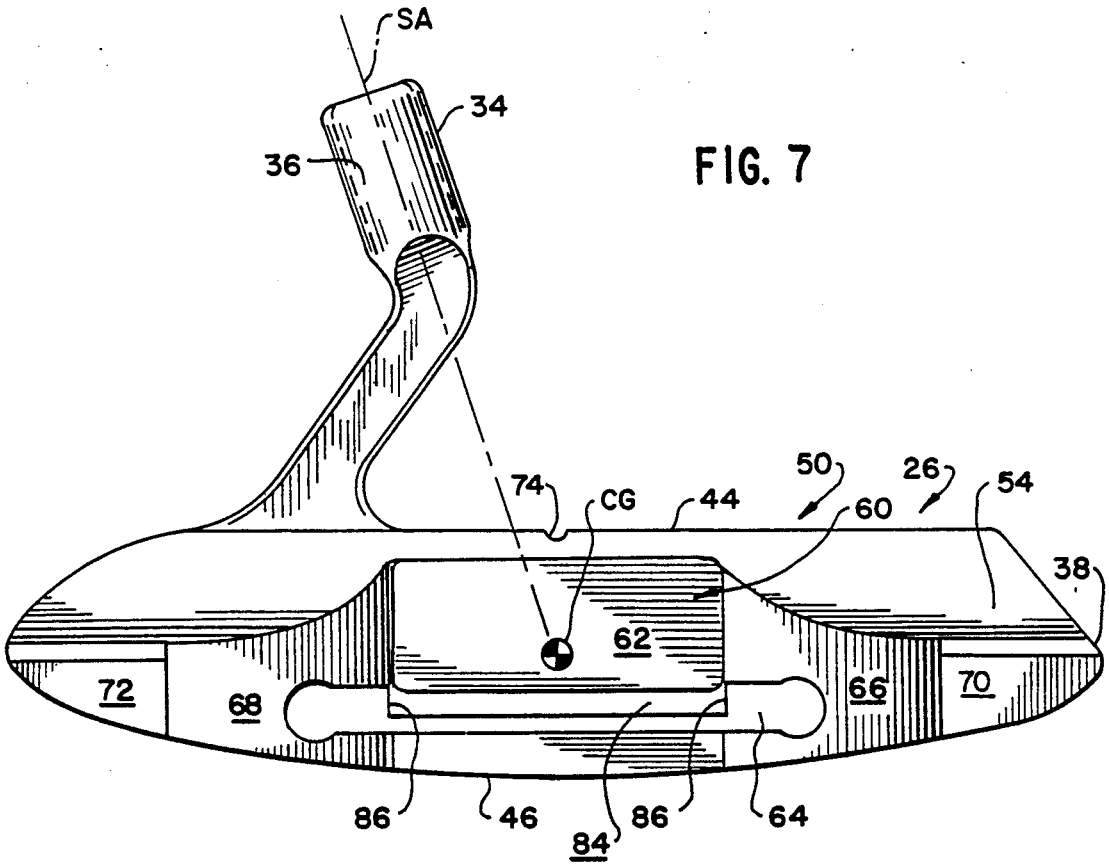
FIG. 7 is a side elevation view of a component of the putter head of FIG. 1.

As seen in FIGS. 6, 7 and 9, the heavyweight component 50 has a horizontally-aligned rear cavity 60 terminating in a generally vertically-aligned rear cavity wall 62. A rearwardly-extending, horizontally-aligned cross bar member 64 (see FIGS. 7–9) spans between the heel and toe weighted wing portions 54, 56 of component 50. This cross bar 64 acts to strengthen and reinforce the body component 50 at the thin central section thereof, i.e., along thin web member 58 (see FIG. 9).

Angled, generally vertically-aligned walls 66, 68 (see FIGS. 7 & 8) are formed on component 50 and extend from the respective ends of the rear cavity 60. The walls 66, 68 terminate respectively in toe rear sidewall 70 and heel rear sidewall 72.

An alignment groove 74, present to alert the golfer where to strike the ball along the face 42, is formed in the top edge surface 44 of heavyweight component 50. The alignment groove 74 is preferably located equidistant between the toe 38 and heel 40 of putter head 26 so as to be geometrically and visually located centrally of the putter's striking face 42. Further, groove 74, operating as the strike point indicator, is aligned directly above the club head's center of gravity, hereinafter "CG", which is discussed more fully below. Also, as seen in FIG. 6, when the groove 74 is aligned centrally of a golf ball, the club head's center of gravity CG is in direct alignment with the ball's center of gravity (hereafter "BCG").

There is shown in FIGS. 10–12 the lightweight body component or central insert 52 of putter body 28. The lightweight insert 52 is formed of a material having a lighter density than that of major body component 50. Preferably, the lightweight insert 52 is formed of a urethane material; it could also be formed of a plastic or aluminum alloy material. Similarly, any other suitable lightweight material having sufficient strength properties for use in golf club manufacture can also be used. Preferably, the density of the lightweight material of insert 52 is such that the heavyweight material of major body component 50 is 65 percent greater than the density of the lightweight material.

Lightweight component 52 is used as an insert member to aesthetically and geometrically fill the void left by the removal, in effect, of heavier weight material (i.e., stainless steel in the preferred embodiment) from the central area of heavyweight body component 50. Thus, as seen in FIGS. 2, 4, 5, 6, 8 and 9, the lightweight insert 52 fills the above-noted central void of body component 50. In the preferred embodiment, the insert 52 also provides a smooth transition, with no readily objectionable or discernible gaps, in the contoured outer surface 48 of putter head 26.

Insert 52 has an outwardly-extending boss portion 76 which is preferably formed so as to be tightly received within the cavity 60 of component 50. In the preferred embodiment the insert 52 has a forward wall 51 (formed on boss 76) and a rear wall 53 (see FIGS. 10–12); forward wall 51 is shorter (along the direction of striking face 42) than rear wall 53. Further, insert 52 has respective toe and heel angled sidewalls 78, 80 (FIG. 10) which correspondingly fit tightly against the respective angled toe and heel sidewalls 66, 68, of component 50 (FIG. 6). Also, insert 52 has an angled ledge 82 (see FIGS. 9 and 12) which correspondingly mates and is tightly received by a chamferred edge 84 formed on the face of the cross bar 64 of component 50. When insert 52 is assembled with component 50, the angled ledge 82 is positionally locked between end walls 86 which are also formed on cross bar 64 (see FIG. 7). The tight engagement of boss 76 against rear wall 62 of rear cavity 60, along with the tight engagement of angled ledge 82 against chamferred edge 84, assures a tight fit of the lightweight insert 52 relative to the heavier body component 50 of putter head 26. The insert 52 is preferably adhesively bonded or otherwise mechanically joined to the stainless steel putter head component 50, to form putter head 26 as an integral unit.

In the preferred embodiment, the rear upper surface 88 of insert 52 is curvably shaped so as to compliment and blend into the curvature of rear surface 48 of body component 50. For example, insert 52 can be formed with a grooved area 90 which corresponds to the grooves 92, 94 formed respectively on the toe and heel portions of rear surface 48. Additionally, as seen in FIG. 11, the lower or sole surface 96 of insert 52 is curved so as to smoothly blend with the curved primary sole surface 46 of body component 50. However, it is to be understood that the exact configuration of the external surface of the insert 52 is not important. Rather, the principal importance of insert 52 is to fill the void formed by the absence of heavyweight material in the central portion of heavyweight body component 50, thus allowing more of the heavier material of body component 50 to be placed in the weighted toe and heel areas of putter head 26, such as in toe and heel weighted wing portions 54, 56. This is important in creating a high moment of inertia for putter head 26.

By way of example, in a putter head made in accordance with the preferred embodiment, it was found that some 95% of the weight making up the putter head 26 is equally distributed in the toe and heel areas. Further, by using a lightweight material for the insert member 52, and preferably one such as urethane, for example (which weighs only 14% of the displaced heavyweight material, such as stainless steel, for example, of component 50), and also by having the insert 52 advantageously form at least a part of the sole area 46, a substantially greater amount of heavyweight material can be positioned in the toe and heel areas than achieved with prior putters. These two factors greatly aid in creating an extremely high moment of inertia for the present putter 20 as described more fully below.

The positioning and alignment of the hosel barrel 34, relative to the putter head body 28, is critical to the intended operation of the present putter. That is, the central axis of shaft 22 (hereinafter referred to as "SA") is purposely so aligned with the putter head 26, via hosel barrel 34 (which extends upwardly and towards the hosel end 40), that the shaft axis SA is coincident with and goes directly through the center of gravity (hereinafter "CG") of the putter head 26. FIGS. 3–7 and 9 depict this with the shaft axis SA directly in line with, in all three planes (i.e., X, Y, and Z - see FIG. 1), the club head's center of gravity CG. Also, as depicted in FIG. 1, the shaft axis SA is purposely coaxially aligned with the entire club's center of gravity (hereinafter referred to as CCG).

In one putter head made in conformance with the preferred embodiment of the present invention, the overall weight for the entire putter 20 was 17.5 ounces (496 grams). The heavyweight component 50 in unfinished form weighed 10.5 ounces (300 grams) and the urethane insert 52 weighed 0.5 ounces (15 grams). The finished putter head 26 (with insert 52 and component 50 integrally joined and in finished form) weighed 11.1 ounces (315 grams). The dimensions of the head 26, from the end of toe 38 to the end of heel 40, was 5.0 inches. The width of head 26, measured at the lowermost center portion of the sole, was 1.1875 inches. The uppermost part of hosel barrel 34 was 2.098 inches above top edge surface 44. The overall height of head 26, measured from the lowermost center point of the sole 46 to the uppermost edge of hosel barrel 34 along a plane vertically bisecting the center of gravity CG and alignment groove 74, was 3.22 inches. The length of the shaft 22 including the grip 24, from tip to tip before assembly with putter head 26, was 33⅛ inches. The length of the forward wall 51 of insert 52 was 1.545 inches, while the length of rear wall 53 of the insert was 3.505 inches.

Preferably, the putter head 26 will weigh between 280 and 340 grams, the major body component 50 will weigh between 270 and 330 grams, and the insert component 52 will weigh no more than 50 grams. Preferably, the length of the putter head 26 is 4.5 inches or greater, and the length of the insert is 1.0 inches or greater.

Importantly, so that the shaft axis SA was assured of being coaxially aligned with both the entire club's center of gravity CCG and the head's center of gravity CG, the hosel barrel 34 was positioned at an angle of 11° off vertical (in the transverse direction of the putter head, see FIG. 4), and was also angled at 18° off vertical (in the lateral direction of the putter head, see FIG. 7).

In the preferred embodiment, the position and alignment of hosel barrel 34 and hosel stem 32, relative to the putter head body portion 28, are such that the putter 20 has a slight onset-type design. That is, it is one where the putter's leading edge (face 42) is in front of the hosel 30 and shaft 22 (see FIGS. 4, 5, 6, and 9). Thus, the advantages provided by the present invention's putter (i.e., allowing the putter to be infinitely balanced coupled with a high moment of inertia) are achieved without having the putter's shaft and hosel obstructing the view of the striking face and the ball at address and ball impact positions. This is a feature highly desired by skilled golfers. Alternatively, the hosel barrel 34 and stem 32 could be affixed to the putter head in other fashions and still achieve the benefits of the present invention, as long as the shaft axis SA remains coaxially aligned with the two centers of gravity, i.e., CCG and CG.

FIGS. 13*a*–13*e* further explain how the presently-disclosed putter is perfectly, infinitely balanced. As shown there, the putter 20 has its head 26 hanging over the edge of a horizontal table surface 98 with the shaft resting on the table. Regardless in what position the putter head 26 is placed, relative to the vertical, head 26 remains where originally placed. In other words, if as shown in FIG. 13*a* the head 26 is aligned vertically with the toe pointing down, it remains that way. Similarly, if the head 26 is placed horizontally (FIG. 13*b*), or canted at an angle (FIG. 13*c*), or again placed vertically but with the toe pointing up (FIG. 13*d*), or canted at another angle (FIG. 13*e*), the putter head 26 remains where placed. This is because the putter 20 is perfectly balanced about the shaft axis SA, which is coaxially aligned with both the putter head's center of gravity CG and the putter's overall center of gravity CCG. Importantly, there are no shaft misalignments (with the club head) or improper weight distributions (within the club head) to affect the perfect balancing of the putter.

In use, if the putter head 26 is placed adjacent a golf ball in a perpendicular address position, relative to the line of putter stroke and the intended line of golf ball travel towards the target, there are no unwanted forces present in club 20 which might otherwise tend to rotate the putter head to an open or closed position during its pendulum swing. Instead, at impact the club face 42 remains exactly where placed, i.e., square to the ball, such as shown in FIG. 6 where the club head's center of gravity CG is in direct alignment with the ball's center of gravity BCG.

Calculations based on a putter made in accordance with the present invention and one prior art putter (PING Anser (trademark)) show that the presently disclosed putter has zero angular acceleration on center hit shots, and a minimal angular acceleration on off-center hit shots, compared to prior art putters. Also, tests done on a moment of inertia test stand reflect that a putter made in accordance with the present invention, having the measurements, weight, and preferred materials disclosed above, has a moment of inertia of 5,130.87 gm-cm$^2$, while the same test for the prior PING Anser (trademark) putter has a substantially smaller moment of inertia, namely, 3,989.4 gm-cm$^2$. Thus, the putter of the present invention has approximately a 29 percent higher moment of inertia than the above-noted prior art putter. Preferably, putters made in accordance with the present invention will have a moment of inertia of at least 4000 gm-cm$^2$.

More specifically, the formula for angular acceleration relative to the moment of inertia is as follows:

$$\text{ANGULAR ACCELERATION} = \alpha = \text{ALPHA} = \frac{(F)(d)}{M.O.I.}$$

$$\text{TORQUE} = T = (F)(d)$$

$$\text{ANGULAR ACCERLEATION} = \frac{\text{TORQUE}}{M.O.I.}$$

WHERE:

F=IMPACT FORCE d=THE MEASURED DISTANCE THAT THE GOLF BALL IS STRUCK OFF CENTER OF THE CLUB HEAD'S CENTER OF GRAVITY, WHICH IS THE AXIS OF ROTATION OF THE PUTTER IN THE PLAYING POSITION. (SEE FIGS. 14 and 16).

M.O.I.=MOMENT OF INERTIA (RELATIVE TO THE AXIS OF ROTATION OF THE PUTTER HEAD).

UNITS:

F=[1 GRAMS CM/SEC$^2$]

d=[CM] $\alpha$=[RADIANS/SEC$^2$]

M.O.I=[GRAMS CM$^2$]

When a ball is struck in the center of the putter head made in conformance with the present invention, the angular acceleration is zero. This is because the club head center of gravity is directly behind the strike point and the ball's center of gravity. (See FIG. 6). This calculates as follows:

$$\alpha = \frac{(F)(d)}{M.O.I.};$$

where d=0

F=1 (held constant for all calculations)

$\alpha$=0

However, in the prior art PING Anser (trademark) putter, for example, the distance d is approximately 0.245 inches (see FIG. 14). Thus, that prior putter inherently creates an angular acceleration, even on center hit balls, which is calculated as follows:

$$\alpha = \frac{(F)(d)}{M.O.I.};$$

where

F=1 (Constant)

d=0.245

M.O.I.=3989

$\alpha = 6.14 \times 10^{-5}$ RAD/SEC$^2$

Further, where a golf ball is struck ¼" towards the toe of the putter made in accordance with the present invention, the angular acceleration created is minimal, calculated as follows:

$$\alpha = \frac{(F)(d)}{M.O.I.};$$

d=0.250"

F=1 (Constant)

M.O.I.=5130

$\alpha = 4.87 \times 10^{-5}$ RAD/SEC$^2$

However, for the prior art PING Anser (trademark) putter, the angular acceleration created by that putter for a golf ball hit ¼" off-center toward the toe, creates a substantially greater angular acceleration, calculated as follows:

$$\alpha = \frac{(F)(d)}{M.O.I.};$$

F=1 (Constant)

d=0.250"+0.245"

M.O.I.=3989

$\alpha = 1.24 \times 10^{-4}$ RAD/SEC$^2$

The following Table No. 1 summarizes the angular acceleration and moment of inertia results for the foregoing:

TABLE 1

| | (ANGULAR ACCELERATION) | | |
|---|---|---|---|
| MODEL | MOMENT OF INERTIA | BALLS STRUCK ON CENTER | BALLS STRUCK ¼" TOWARDS TOE |
| PRESENT IN-VENTION | 5130 gcm$^2$ | 0 | $4.87 \times 10^{-5} \frac{rad}{sec^2}$ |
| PING ANSER | 3989 gcm$^2$ | $6.14 \times 10^{-5} \frac{rad}{sec^2}$ | $12.41 \times 10^{-5} \frac{rad}{sec^2}$ |

The present invention is not limited to the design of putter depicted in the accompanying drawings, but instead can be used with various different shapes of putters. The only requirements are that the putter's shaft axis be coaxially aligned with both the entire club's center of gravity and the club head's center of gravity, that the latter be aligned centrally of the putter head and in direct alignment with the putter's strike point, and that the toe and heel areas be highly weighted so as to achieve a high moment of inertia.

Figure 2:
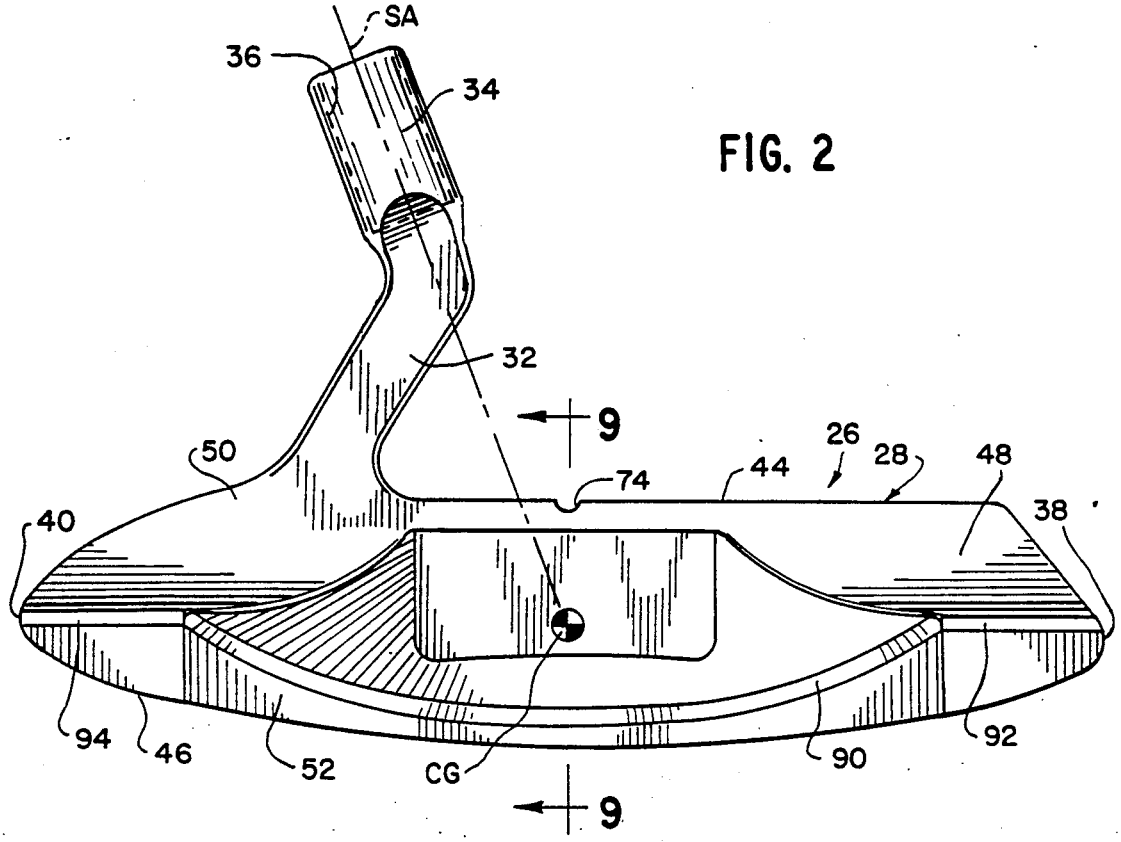
FIG. 2 is a rear elevation view of the putter head of the club of FIG. 1.
Figure 3:
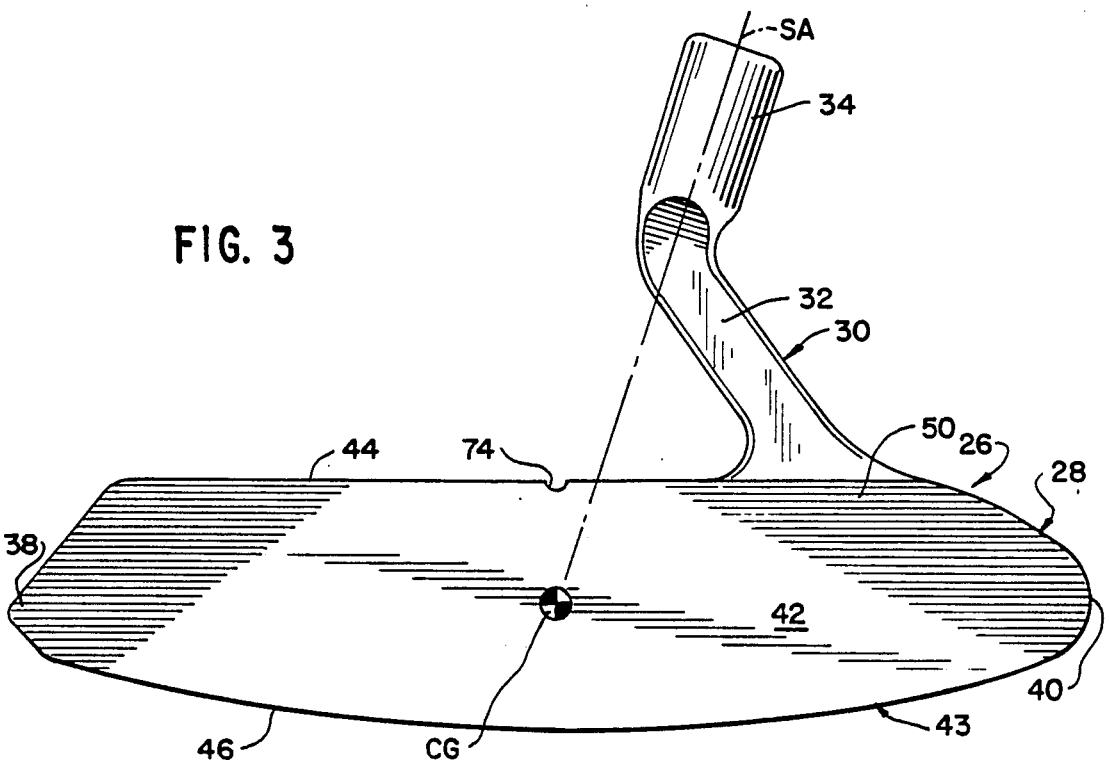
FIG. 3 is a front elevation view of the putter head of FIG. 1.

Further, the putter 20 shown in FIG. 2 has a lie angle of approximately 18° (angle of shaft axis to a plane perpendicular to the ground for a properly grounded club), which most club manufacturers use as a standard. The lie angle for putter 20 could be changed, such as to 3° flat (i.e., 21° lie), or 3° upright (i.e., 15° lie). However, any such changes in lie angle require that care be taken in forming body component 50 (whether it is formed by investment casting, for example, or otherwise) so as to assure that the hosel barrel 34, and hence shaft 22, are so aligned with club body 50 that the shaft axis SA remains coaxially aligned with the two centers of gravity, i.e., CCG and CG. In practice, a significant change in lie angle, i.e., 3° from the standard of 18° lie, has been found to require relocating and repositioning the alignment of hosel barrel 34 on club body 50. That is, one cannot merely bend the hosel stem 32 (relative to club body 50) to obtain a different lie angle, and still receive the infinitely balanced advantage of the present invention.

The putter 20 is very helpful when used in so-called "plumb bobbing" sighting exercises during actual putting. This is because, regardless which way the putter's toe points when the putter is held vertically by the grip end, the putter shaft will always be aligned truly vertical, as it goes through the entire club's center of gravity CCG.

It is thus seen that the presently-disclosed infinitely balanced putter club coupled with a high moment of inertia minimizes the amount of unwanted angular acceleration that can be imparted to a golf ball, thereby rendering the present putter substantially more accurate than other known putters.

From the foregoing, it is believed that those skilled in the art will readily appreciate the unique features and advantages of the present invention over previous types of golf club putters. Further, it is to be understood that while the present invention has been described in relation to a particular preferred embodiment as set forth in the accompanying drawings and as above described, the same nevertheless is susceptible to change, variation and substitution of equivalents without departure from the spirit and scope of this invention. It is therefore intended that the present invention be unrestricted by the foregoing description and drawings, except as may appear in the following appended claims.

We claim:

1. An improved golf club for preventing unwanted angular acceleration and having a high moment of inertia to resist twisting on off-center hit shots, said improved golf club having a shaft carrying a grip, a club center of gravity, a club head affixed to said shaft, said club head having a front striking face, a sole surface, an upper surface, a heel, a toe, a hosel for affixing said shaft to said club head, and a club head center of gravity, the improvement comprising:

a major club head component formed of a heavyweight material and forming said striking face and said hosel, said major club head component having a massive weighted toe portion, a massive weighted heel portion, and an elongated central void area formed both behind said striking face between said massive weighted toe and heel portions and along part of said upper surface and part of said sole surface;

an insert component formed of a lightweight material and operable, when securely affixed to said major club head component, to structurally and aesthetically completely fill said central void area while permitting the differential in weight between said heavyweight material and said lightweight material, for a given weight golf club head, to be distributed in said massive weighted toe and heel portions, to thereby provide uniform weight distribution and to create a high moment of inertia for said golf club, both about said club head center of gravity and said club center of gravity;

a strike point located centrally of said striking face along the length thereof, said club head center of gravity being in direct alignment with said strike point in a plane perpendicular to the striking face; and said hosel being so positioned and aligned relative to said club head as to assure that the central axis of said shaft is coaxially aligned with both said club head center of gravity and said club center of gravity, thereby resulting in an infinitely balanced golf club which prevents unwanted angular acceleration from being imparted to said golf club head by a golf ball on center hit impacts.

2. The invention of claim 1, said hosel comprising at least two sections including a first hosel section being affixed to said major club head component and extending upwardly from said club head towards said toe, and a second hosel section affixed to said first hosel section and extending upwardly from said club head towards said heel, said second hosel portion being so aligned relative to said club head as to cause said central axis of said shaft to be coaxially aligned with said club head center of gravity and said club center of gravity.

3. The invention of claim 2, wherein said upwardly-extending first hosel section also extends inwardly of said front striking face relative to said club head.

4. The invention of claim 1, wherein said hosel is so affixed to said club head as to create an onset-style golf club, whereby a golfer has an unobstructed view of the ball and said club head's striking face at the address position.

5. The invention of claim 1, wherein said heavy-weight material for said major club head component is formed of a metallic material.

6. The invention of claim 5, wherein said metallic material is stainless steel.

7. The invention of claim 1, wherein said lightweight material for said insert component is formed of a plastic material.

8. The invention of claim 9, wherein said lightweight material is urethane.

9. The invention of claim 1, wherein said major club head component includes a horizontal bar member extending between said massive weighted toe portion and said massive weighted heel portion and extending rearwardly into said cavity for tightly receiving and supporting said insert component.

10. The invention of claim 1, wherein said golf club head weighs between 280 grams and 340 grams.

11. The invention of claim 10, wherein said major club head component weighs between 270 and 330 grams.

12. The invention of claim 10, wherein said insert component weighs no more than 50 grams.

13. The invention of claim 10, wherein said golf club head has a moment of inertia greater than 4000 gm-cm$^2$.

14. The invention of claim 1, wherein said golf club head has a length of greater than 4.5 inches.

15. The invention of claim 1, wherein the length of said insert component is greater than 1.0 inch.

16. The invention of claim 1, wherein said insert component includes a boss portion extending forwardly towards said major club head component, and said major club head component includes a boss-receiving cavity for tightly engaging said boss portion when said major club head component and said insert component are securely affixed together.

17. A golf putter having a high moment of inertia and preventing unwanted angular acceleration, said golf putter comprising in combination a shaft having a central axis, a grip, a club head affixed to said shaft, a club center of gravity, said club head having a front striking surface, an upper surface, a sole surface, a heel portion, a toe portion, a central portion extending between said toe and heel portions and behind said striking surface, a hosel member affixing said club head to said shaft, and a club head center of gravity;

said club head further having a major body component formed of a first material and including at least said striking surface, said heel portion, said toe portion and a part of said sole surface, said heel portion and said toe portion both being massively-weighted, wing-shaped members;

a second body component secured to said major body component and having a forward wall and a rear wall and forming the majority of said central portion, said second body component being exposed so as to form at least a part of said club head's upper surface and a part of said sole surface, said second body portion formed of a second material;

said first material having a density that is at least 65 percent greater than the density of said second material, whereby said differential in densities between said first material and said second material is distributed within said massively-weighted heel and toe portions so as to maximize the moment of inertia for said golf putter about said club head center of gravity;

a strike point located centrally along said club head's front striking surface, and said club head center of gravity being directly aligned with said strike point in a plane perpendicular to said striking surface; and said hosel member being so positioned and so aligned relative to said club head that said club head center of gravity and said club center of gravity are coaxially aligned along said shaft central axis, thereby providing infinite balancing of said golf putter about said shaft central axis and preventing creation of unwanted angular acceleration to said club head as a result of golf balls hit on said club head strike point.

18. The invention of claim 17, wherein said first material is stainless steel.

19. The invention of claim 17, wherein said second material is urethane.

20. The invention of claim 17, wherein said major body component includes said hosel member.

21. The invention of claim 17, wherein said second body component has a rear wall and forward wall, both relative to said striking surface, said rear wall being longer than said forward wall in a direction generally along said striking face.

22. The invention of claim 21, wherein said second body component has respective toe and heel side walls, said side walls slanting generally outwardly and rearwardly away from one another relative to said forward wall.

23. The invention of claim 17, wherein said massively-weighted toe and heel portions have respective interior side walls, and second body component has side walls which are correspondingly shaped to respectively abut against said interior side walls of said toe and heel portions.

24. The invention of claim 17, and wherein said second body component has respective side walls extending between said forward wall and said rear wall thereof and aligned at an angle relative to said striking surface.

* * * * *

UNITED STATES PATENT AND TRADEMARK OFFICE

CERTIFICATE OF CORRECTION

PATENT NO. : 5,078,398

DATED : January 7, 1992

INVENTOR(S) : Timothy R. Reed & James E. Karner

It is certified that error appears in the above-identified patent and that said Letters Patent is hereby corrected as shown below:

In column 11, line 40, Claim 8, "The invention of claim 9" should be --The invention of claim 7--

Signed and Sealed this

Fourth Day of May, 1993

*Attest:*

Michael K. Kirk

MICHAEL K. KIRK

*Attesting Officer*

*Acting Commissioner of Patents and Trademarks*